United States Patent [19]

Lapke et al.

[11] Patent Number: 4,575,694

[45] Date of Patent: Mar. 11, 1986

[54] COAXIAL CONNECTOR

[75] Inventors: James A. Lapke, Shelton; Carl W. Schmelzle, Westport, both of Conn.

[73] Assignee: Allied Corporation, Morris Township, Morris County, N.J.

[21] Appl. No.: 586,468

[22] Filed: Mar. 5, 1984

[51] Int. Cl.[4] ..... H01P 1/10; H01P 1/26

[52] U.S. Cl. ..... 333/22 R; 200/51.1; 333/260; 333/262; 338/220

[58] Field of Search ..... 333/1, 101, 105, 22 R, 333/32, 33, 260, 262, 127; 200/51.1, 153 S; 338/220

[56] References Cited

U.S. PATENT DOCUMENTS

| | | | |
|---|---|---|---|
| 2,640,118 | 5/1953 | Werner | 200/51.1 X |
| 3,525,056 | 8/1970 | Qurashi | 333/22 R |
| 3,784,950 | 1/1974 | Coffman | 333/22 R X |
| 3,873,785 | 3/1975 | Lieberman | 333/260 X |

*Primary Examiner*—Paul Gensler
*Attorney, Agent, or Firm*—C. D. Lacina

[57] ABSTRACT

A make-before-break switch arrangement and a circuit element are disposed in a connector shell, the shell having an electrically conductive connector contact and being adapted to couple to a coaxial cable having a shield conductor and a center conductor whereby when disconnected from a compatible connector, an electrical signal passes through a first circuit path comprising the shield conductor, the circuit element, the connector contact and the center conductor, but when connected to the compatible connector, the electrical circuit path does not include the circuit element but passes through the center conductor, the connector contact and a contact in the compatible connector with EMI shielding being maintained through the shield conductor, the shell and the barrel of the compatible connector.

5 Claims, 6 Drawing Figures

COAXIAL CONNECTOR

This invention relates to a coaxial connector including an electrical impedance element and a switch arrangement which simultaneously breaks a first circuit path including the impedance element simultaneously with completing a second path excluding the impedance element.

In many radio frequency (RF) and data transmission systems a source transmission line cannot be left unterminated (i.e. without an impedance load). A coaxial cable is "loaded" when, although unterminated, an electrical signal through the cable is presented with a constant characteristic impedance. Adverse results from an unloaded or unterminated cable would be unwanted reflection of an electrical signal back to the system source or other system connections, phased so that the signal integrity and system balance are destroyed.

Accordingly, it would be desirable to have a connector which, when connected to a coaxial cable such as by being terminated thereto, would provide a constant electrical impedance load to the transmission line in the case of an unwanted disconnect but which would not interfere with a supplied signal when the connector is mated therewith.

A connector in accord with this invention disposes a circuit element, such as a resistor, in an electrically conductive shell to electrically couple the shield conductor and center conductor of a coaxial cable electrically connected thereto and a make-before-break circuit path switching arrangement causing either of an electrically conductive contact or a dielectric sleeve electrically isolating the contact to the shell to move from a first position wherein the circuit element is electrically coupled to the cable and to a second position wherein the circuit element is electrically uncoupled to the cable.

One advantage of a connector having a make-before-break switch arrangement in combination with an electrical circuit element is an ability of an existing system to be easily retrofitted with one or more impedance elements to protect a cable when unconnected.

One way of carrying out the invention is described below with reference to the drawings which illustrate specific embodiments of this invention; in which FIG. 1 is a cross-section of an electrical coaxial connector terminated to a coaxial cable about to mate with a compatible connector.

Figure 1:
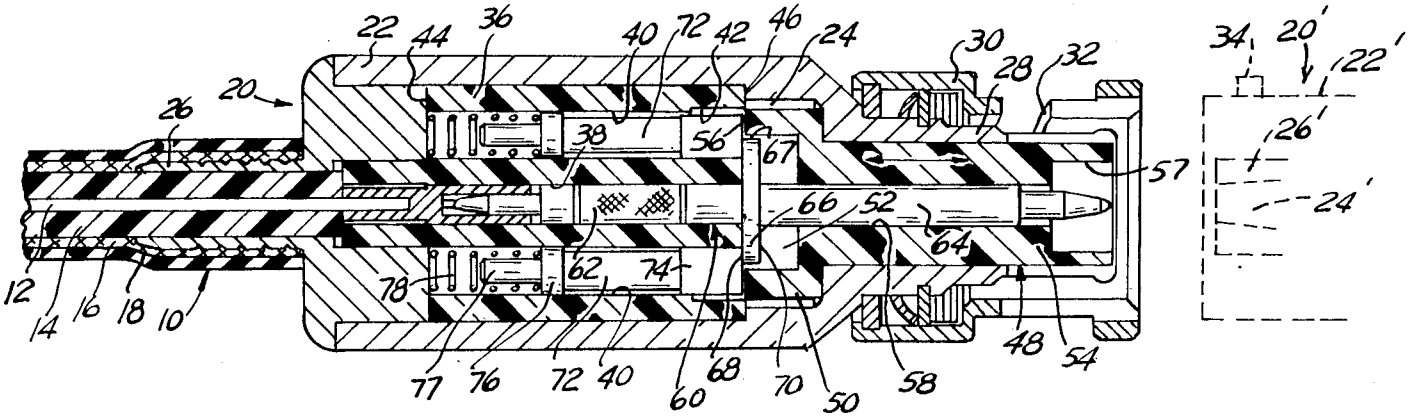

Referring now to the drawings, FIG. 1 shows a coaxial connector 20 terminated to a coaxial cable 10 and about to connect to a compatible electrical connector 20'. The cable includes a center conductor 12, a dielectric body 14 surrounding the center conductor, a braid shield conductor 16 encircling the body, and an outer protective jacket 18. Coaxial connector 20 comprises a generally cylindrical shell 22 of electrically conductive material having an interior cavity 24, a rearward ferrule 26 for receiving the braid shield conductor 16 and passing the center conductor 12 into the cavity and a forward portion 28 for mating with a mating shell 22' of the compatible connector 20'. As shown a bayonet coupling arrangement, such as typically found on BNC-type connectors, is provided by a coupling ring 30 having a groove 32 for engaging a pin 34 extending from the compatible connector.

A generally cylindrical insert 36 of dielectric material is fixedly mounted in the cavity 24 of shell 22, the insert including a front face 46, a rear face 44, a central passage 38 having a central axis generally coaxial to center conductor 12 and a plurality of outer passages 40 having a primary axis, the passages extending between the end faces, the central and primary axes being parallel and the locus of primary axes forming a circle concentrically disposed about the central axis. A cylindrical pocket 42 extends axially rearward from front face 46 of the insert, the pocket being coaxial to central axis and circumscribing the outer passages. A stepped, generally cylindrical sleeve 48 comprised of dielectric material is mounted within the interior cavity 24 of shell 22 forwardly of insert 36, the sleeve including a rearward sleeve portion 50 having a rearward recess 52, a forward sleeve portion 54 having a forward recess 57, and a central bore 58 extending axially therethrough, the recesses 52,57 being concentric with the bore 58 and the bore having its central axis coaxial with the central axis of central passage 38.

A connector contact 60 of electrically conductive material is positioned within and in electrical isolation to the shell 22, the connector contact including a first contact portion 62 fixedly secured in central passage 38 and terminated to center conductor 12, a second contact portion 64 located in central bore 58, and a medial shoulder portion 66, the shoulder portion being located between the first and second contact portions and having an outer rim 67 received in rearward recess 52, a rearward face 68 abutting against part of end face 46 of the insert 36, and a forward face 70 facing the endwall of rearward recess 52. The diameter defining the interior wall of pocket 42 is slightly greater than an outer diameter of the rearward rearward sleeve portion 50 such that the sleeve portion can retract into the pocket 42 of dielectric insert 36.

A circuit element 72, such as a resistor, is disposed in one or more of the outer passages 40, each circuit element including a forward cap 74 and a rearward cap 76 including a stem 77, each cap being of electrically conductive material and in electrical circuit relation with the circuit element. An electrically conductive coil spring 78 is sized to fit in the outer passage, the spring having one end abut shell 22, its other end abut rearward cap 76 and its coils disposed around stem 77 to bias circuit element 72 forwardly relative to its outer passage 40 and forward cap 74 against rearward face 68 of connector contact 60 to thereby complete an electrical circuit path therebetween.

Figure 2:
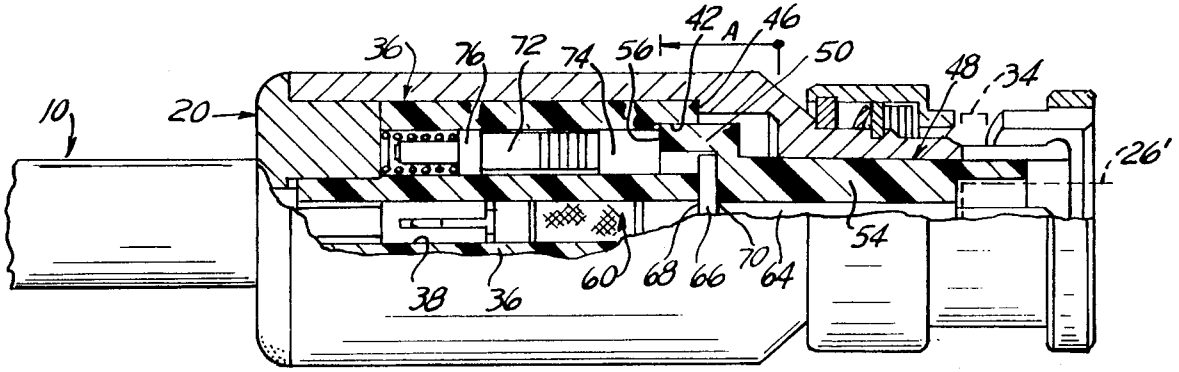
FIG. 2 is similar to FIG. 1 and is partially in cross-section to show the mated relation with the compatible connector.

FIG. 2 shows a completed connection. In operation, when compatible connector 20' is not connected to coaxial connector 20, a first electrical circuit path between shell 22, coil spring 78, circuit element 72 and connector contact 60 electrically couples an electrical signal between braid shield conductor 16 and center conductor 12 and provides electromagnetic protection to an unconnected cable. The circuit element has a predetermined value (e.g., a resistance). As such, the circuit element provides an electrical signal passing through the cable 10 and the first circuit path with a predetermined electrical impedance when the cable is not connected. When compatible connector 20' is connected to coaxial connector 20, its compatible contact element 24' and dielectric sleeve 26' enter forward recess 57 of stepped sleeve 48, thereby causing insert 26' to bottom against the endwall of forward recess 57, dielectric sleeve 48 to retract rearwardly and rearward sleeve portion 50 thereof to enter pocket 42, and rearward sleeve portion 50 to drive circuit element 72 axially rearward, thereby interrupting abutting contact between forward cap 74 of circuit element 72 and shoulder portion 66 of connector contact 60. As a result of this connection, shield conductor 16, shell 22 and the barrel 22' of compatible connector 20' provide electromagnetic interference protection to an electrical signal passed through the center conductor 12, the connector contact 60 and the compatible contact element 24' of the compatible connector 20'. The arrow designated at "A" shows the separation of cap 74 from contact with shoulder portion 66 of connector contact 60. The phantom lines show, respectively, pin 34 received in groove 32 and dielectric insert 26' bottomed in forward recess 56.

Figure 3:
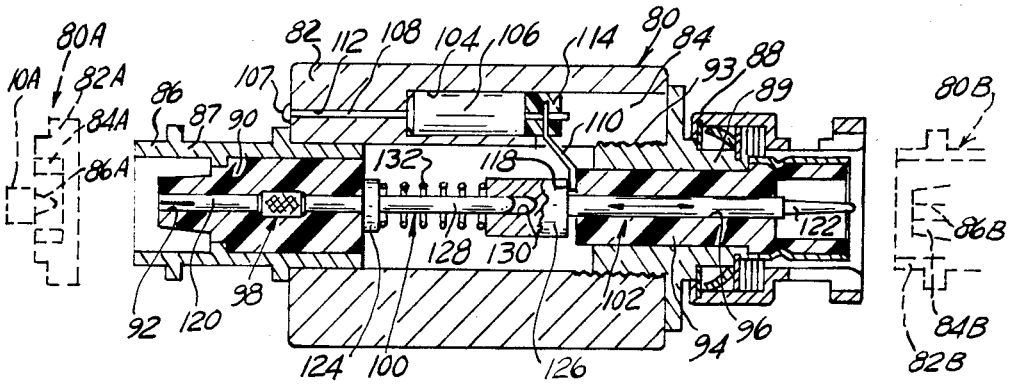
FIG. 3 is a cross-section view of a connector-to-connector adaptor having an adaptor shell about to mate with a pair of compatible connectors.

FIG. 3 shows an alternate configuration representing a connector-to-connector adaptor 80 for mating a first compatible connector 80A shown as terminated to coaxial cable 10A to a second compatible connector 80B terminated to an electrical apparatus or electrical cable (not shown), the first and second compatible connectors 80A, 80B being shown in phantom and each including, respectively, an electrically conductive barrel 82A, 82B, a dielectric insert 84A, 84B, and an electrically conductive contact element 86A, 86B. Typically, the barrels 82A, 82B would be standard BNC type connectors.

The adaptor 80 comprises an electrically conductive shell 82 having an interior cavity 84 and internal thread 83 (shown best in FIG. 5), a rearward connector 86 including a connector barrel 87 of electrically conductive material, and a forward connector 88 including an electrically conductive barrel 89 having external thread 93 for threadably engaging the internal thread, the rearward and forward connectors 86, 88 being mounted to shell 82 with their barrels 87, 89 being configured for mating with the respective compatible barrels 82A, 82B. An insert 90 of dielectric material having a center passage 92 extending coaxially therethrough is fixedly mounted in rearward connector 86 and a dielectric sleeve 94 having a center bore 96 extending coaxially therethrough is fixedly mounted in forward connector 88. A connector contact 100 of electrically conductive material is comprised of two parts and includes a rearward first contact portion 98 fixedly secured in passage 92 and a forward second contact portion 102 movably disposed in center bore 96.

Figure 5:
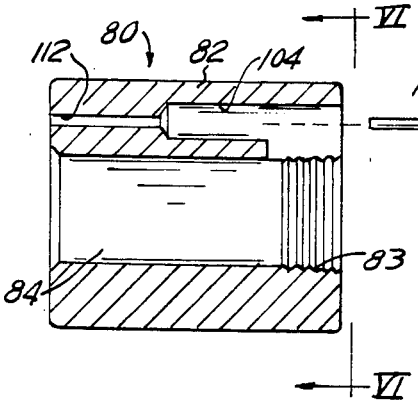
FIG. 5 is a partial view in section of the adaptor shell.
Figure 5:
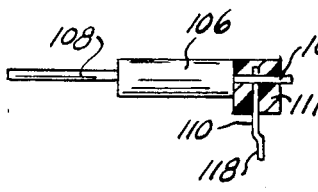
Figure 6:
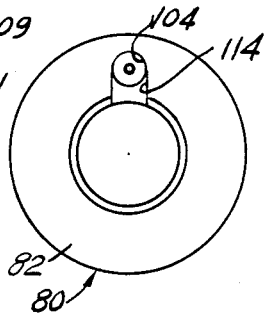
FIG. 6 is an end view of the adaptor shell taken along line VI—VI of FIG. 5.

The shell 82 includes an outer passage 104 communicating with interior cavity 84 for receiving a circuit element 106, the circuit element including a circuit rearward contactor 108 for electrically coupling the element to shell 82 and to rearward connector 86, and although shown best by referring to FIG. 5, a conductive stem 109 is connected to a conductive forward contactor 110 for electrically coupling the circuit element to connector contact 100, a dielectric support 111 being formed about the stem 109 and forward contactor 10. Outer passage 104 includes a rearward passage portion 112 extending through the shell for receiving rearward contactor 108 and a forward passage portion 114 for receiving support 111 and locating forward contactor 110.

Solder 107 electrically connects rearward contactor 108 to shell 82 of the adaptor 80. Forward contactor 110 extends from circuit element 106 and inwardly into cavity 84 as a cantilever beam to its distal free end 118 which is abutted against dielectric sleeve 94.

As indicated, connector contact 100 is not integrally formed and includes, respectively, first contact portion 98 being fixedly secured in insert 90 and second contact portion 102 slidably disposed in sleeve 94, the first contact portion 98 and the second contact portion 102 having, respectively, a mating end 120, 122 and a shoulder portion 124, 126, the mating ends 120, 122 being configured for mating, respectively, with the compatible contact elements 86A, 86B of the compatible connectors 80A, 80B, the shoulder portions 124, 126 extending into cavity 84 and each provided, respectively, with an axial pin body 128 and an axial opening 130, the opening being sized for receiving the pin body 128. Shoulder portion 126 of second contact portion 102 is adapted to abut against and retract inwardly from contact with, respectively, free end 118 when second contact portion 102 is in the first and the second positions, the pin body 128 being slidably disposed in the opening.

A coil spring 132 of electrically conductive material is disposed around pin body 128 of first contact portion 98, the coil spring having one end thereof abutting shoulder portion 124 of first contact portion 98 and the other end thereof abutting shoulder portion 126 of second contact portion 102, thereby normally biasing second contact portion 102 against free end 118.

Figure 4:
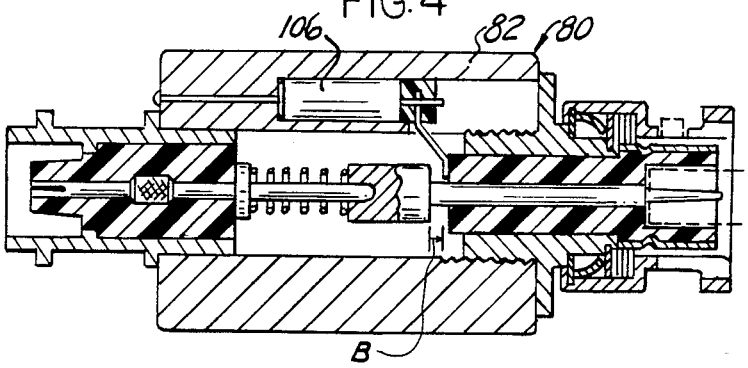
FIG. 4 is similar to FIG. 3 and shows the mated connection.

FIG. 4 shows (in phantom) the result of adapter 80 mating with compatible connector 80B. Compatible contact 86B drives second contact portion 102 rearwardly relative to dielectric sleeve 92 and into cavity 84, thereby driving the shoulder portion 126 from abutting relation with contactor 110 and from electrical circuit relation with the circuit element 106. The arrow designated at "B" shows the separation of shoulder portion 126 from contact with the contactor 110.

FIG. 5 shows adaptor shell 82 and circuit element 106 removably positioned for mounting in passage 104. The circuit element includes the dielectric support 111 for supporting the conductive stem 109 and contactor 110 therewithin.

FIG. 7 shows an end view of adaptor shell 82 and forward passage portion 114 having a squared entry for locating forward contactor 10 from circuit element 106 relative to interior cavity 84 of the shell.

The above coaxial connector embodiments provide a make-before break-switching arrangement whereby an impedance element is in an electrical circuit path including the center conductor and the shield conductor of a cable whenever the coaxial connector is disconnected and is excluded from the electrical circuit path when the cable is connected, the connection providing a transmission path for an electrical signal which passes through the center conductor, the connector contact and the compatible contact with the electrically conductive connector shell being coupled to the shield and barrel of the compatible connector to maintain EMI shielding.

We claim:

1. A coaxial connector for electrically coupling with a coaxial cable having a center conductor encircled by a shield conductor, comprising a shell of electrically conductive material, an insert of dielectric material fixedly secured to said shell, a connector contact of electrically conductive material fixedly mounted in said insert and disposed in electrical isolation to said shell, an electrical circuit element electrically connected to said shell and said contact, the electrical connection completing a first electrical circuit path including the circuit element, the shield conductor, and the center conductor when said coaxial connector is disconnected from a compatible connector, and make-before-break switch means for breaking said first electrical circuit path including said circuit element and simultaneously establishing a second electrical circuit path excluding said circuit element when connected to the compatible connector, said second electrical circuit path including said center conductor, the connector contact, and a compatible contact of the compatible connector when mated therewith, characterized by said insert including a passage which receives said circuit element and a pocket, a dielectric sleeve disposed in said shell for movement between a first position completing the first electrical circuit path and a second position establishing the second electrical circuit path, said sleeve having a forward portion sized to fit said pocket, a rearward portion, and a bore extending therethrough, said connector contact having a contact portion disposed in said bore, mechanical means for biasing the circuit element into electrical circuit relation with the contact portion, said circuit element including an electrically conductive contactor which is biased into contact with said rearward portion and said connector contact when the dielectric sleeve is in the first position, said forward portion being adapted to be abutted by the compatible connector during mating whereby to force the dielectric sleeve rearwardly and drive the contactor from abutment with the compatible contact when in the first position and out of contact therewith when driven to the second position.

2. The connector as recited in claim 1 wherein said insert includes a plurality of passages disposed about the connector contact with each such passage receiving an electrical circuit element.

3. The connector as recited in claim 1 wherein said bias means comprises a coil spring of electrically conductive material, said spring being disposed in the passage with one end of the spring abutting the shell and the other end of the spring abutting the circuit element and being in electrical circuit relation therewith.

4. The connector as recited in claim 1 wherein said circuit element comprises a resistor having a resistance value such that the electrical signal passing through the cable and the first electrical circuit path has a predetermined electrical impedance when the compatible connector is disconnected.

5. The connector as recited in claim 4 wherein said shell includes a ferrule for receiving and terminating the coaxial cable, said shield conductor being received around the ferrule and said center conductor being passed through the ferrule and terminated to said connector contact.

* * * * *